US005971866A

United States Patent [19]

Adams et al.

[11] Patent Number: 5,971,866

[45] Date of Patent: Oct. 26, 1999

[54] WEDGE TYPE GOLF CLUB TRI-LEVEL SOLE CONFIGURATION

[75] Inventors: Byron H. Adams, Dallas; Richard H. Murtland, Plano; Richard M. Nelson, Dallas, all of Tex.; Nicholas A. Faldo, Surrey, United Kingdom

[73] Assignee: Adams Golf, Inc., Plano, Tex.

[21] Appl. No.: 09/236,559

[22] Filed: Jan. 26, 1999

[51] Int. Cl.[6] ..... A63B 53/04

[52] U.S. Cl. ..... 473/328; 473/350

[58] Field of Search ..... 473/349, 350, 473/328, 324, 344, 290, 291; D21/747, 748, 749, 750, 751, 752

[56] References Cited

U.S. PATENT DOCUMENTS

| | | | |
|---|---|---|---|
| D. 215,608 | 10/1969 | Lysaght | D34/5 |
| 2,705,147 | 3/1955 | Winter . | |
| 3,088,736 | 5/1963 | Mospan | 473/328 |
| 3,897,065 | 7/1975 | Solheim | 473/349 |
| 5,301,944 | 4/1994 | Koehler . | |
| 5,377,983 | 1/1995 | Fenton | 473/328 |
| 5,465,970 | 11/1995 | Adams | 473/349 |
| 5,549,296 | 8/1996 | Gilbert . | |
| 5,573,469 | 11/1996 | Dekura . | |
| 5,603,668 | 2/1997 | Antonious | 473/328 |
| 5,643,106 | 7/1997 | Baird . | |
| 5,800,281 | 9/1998 | Gilbert . | |
| 5,813,919 | 9/1998 | Best et al. . | |
| 5,833,551 | 11/1998 | Vincent et al. | 473/350 |

FOREIGN PATENT DOCUMENTS

| | | |
|---|---|---|
| 160030 | 3/1921 | United Kingdom . |

*Primary Examiner*—Sebastiano Passaniti
*Attorney, Agent, or Firm*—Aquilino & Welsh

[57] ABSTRACT

An iron type golf club head including a bottom sole having a first level support surface at a first angle relative to the ball striking face, a second level support surface at a second angle relative to the ball striking face, and a third level support surface offset laterally from the first and second levels at a third angle relative to the ball striking face.

4 Claims, 2 Drawing Sheets

WEDGE TYPE GOLF CLUB TRI-LEVEL SOLE CONFIGURATION

BACKGROUND AND SUMMARY OF THE INVENTION

The present invention relates to wedge type golf clubs and, in particular, to a wedge club having three distinctive ground engaging surfaces.

The rules of golf require that no more than fourteen golf clubs be used in the playing of a round of golf. This requires a golfer to select particular golf clubs in order to execute the shots anticipated during the playing of a particular round. Normally a golfer will use a putter and at least two wood or metalwood type golf clubs for longer tee and fairway shots. This leaves ten or eleven iron type golf clubs which are then used to complete the fourteen club set. Currently there are a number of wedge type golf clubs available with various lofts ranging from a 52° angle up to and including as high as a 65° angle. Most manufacturers provide a range of four to five wedge type golf clubs, each having different loft and club head configurations to satisfy an individual golfer. Assuming a golfer uses a standard selection of irons, that is, for example, a three iron through a nine iron, a golfer may be limited to two and, at the most, three wedges in keeping withing the fourteen club limit. For golfers who prefer to use multiple wedges, often this results in a golfer not being able to use one or more of his wedge type golf clubs.

Normally the sole or bottom surface of a golf club is designed to lie flat on the ground surface to position the club face at a predetermined face loft angle. A golfer may manipulate the club face of a particular lofted club to alter the loft face angle, however this results in the sole of the club head being angled, that is not flat, with respect to the ground surface. To enable a golf club to be used for a number of different loft angles, golf clubs with multiple uses have been developed having a plurality of ground engaging surfaces, each with different angular configurations whereby a single golf club may functionally take the place of two or more golf clubs with different lofts. For example, U.S. Pat. No. 2,705,147 to Winter shows a wood type golf club head having a plurality of sole surfaces each having a different angle in order to adjust the loft angle of the golf club.

U.S. Pat. No. 5,549,296 to Gilbert shows a golf club having a three surface sole; a positive bounce sole, a trailing sole surface and a crescent surface between the two having a substantially straight front border and a crescent shaped curved rear border.

Another U.S. Pat. No. 5,800,281 to Gilbert shows a golf club sole configuration including three surfaces; an entrance surface, a bounce surface and a trailing surface. The sole also includes a first and second cavity located between the bounce surface and the toe and between the bounce surface and the heel.

U.S. Pat. No. 5,643,106 to Baird shows a golf club head with a sole having a double convex profile which defines separate convex bounce surfaces and a recessed channel disposed between the bounce surfaces.

U.S. Pat. No. 5,301,944 to Koehler shows a golf club head having a dual sole configuration wherein the leading edge has a positive bounce angle and the trailing edge also has a positive bounce angle which is less than the angle of the leading edge.

The present invention is directed to a high lofted, wedge type iron golf club head having an improved, multi-level sole configuration. The multi-level configuration includes three separate angular sole surfaces whereby the club may be placed flat on a ground supporting surface at one of three different loft angle positions such that a first sole surface corresponds to a lower lofted golf club, a second sole surface corresponds to an intermediate lofted golf club and a third sole surface corresponds to a higher lofted golf club. The first surface extends from the leading edge of the club head to approximately the midpoint on the sole in a front to rear direction. The second surface extends from the midpoint to the rear edge. The third surface is formed offset from the first two surfaces in a direction toward and adjacent to the heel. Each surface is formed at a different angle, thereby allowing the golf club to be placed on a support surface and used with a different loft angle permitting a golfer to hit a variety of shots with a single golf club.

Whereas, the angles of the three distinct ground engaging surfaces may take a wide variety of angular ranges, preferably the different levels correspond to the angular lofts normally found on wedge type golf clubs, including but not limited to pitching wedges, sand wedges and lob wedges. For example, the first surface may create a loft angle relative to the ball striking face corresponding to a normal loft angle of a pitching wedge. The second surface may create a loft angle relative to the ball striking face corresponding to a sand wedge. The third surface may create a loft angle relative to the ball striking face corresponding to a lob wedge.

Among the objects of the present invention is the provision of an iron type golf club head which may be used in a variety of loft configurations.

Another object of the present invention is the provision of a iron type golf club head which may be used as a pitching wedge, a sand wedge and a lob wedge.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
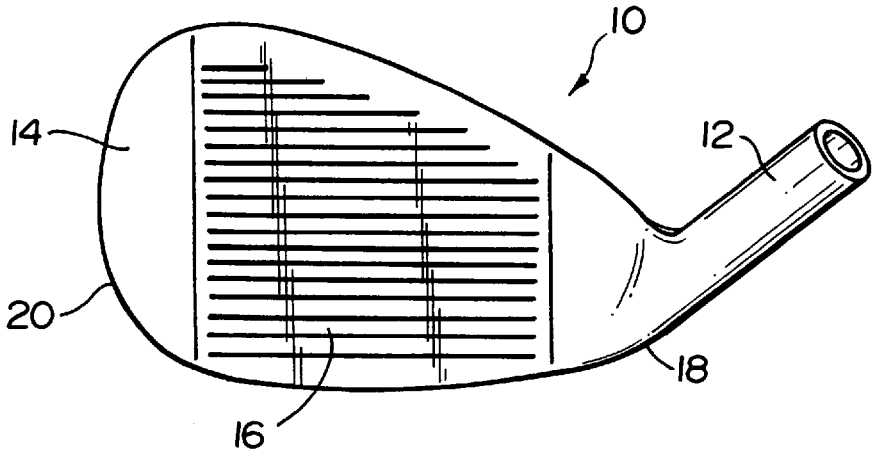
FIG. 1 is front perspective view of a golf club head in accordance with the present invention.
Figure 2:
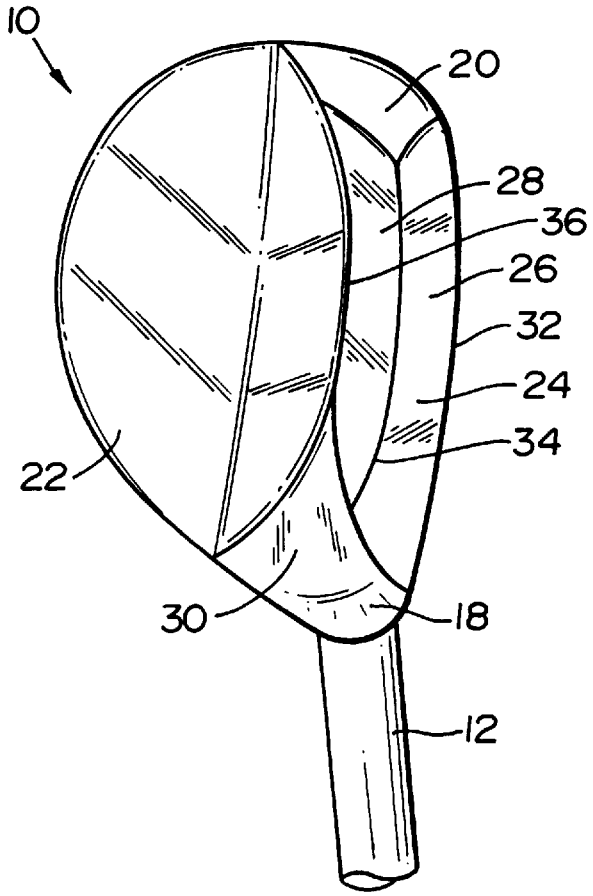
FIG. 2 is a bottom view thereof.
Figure 3:
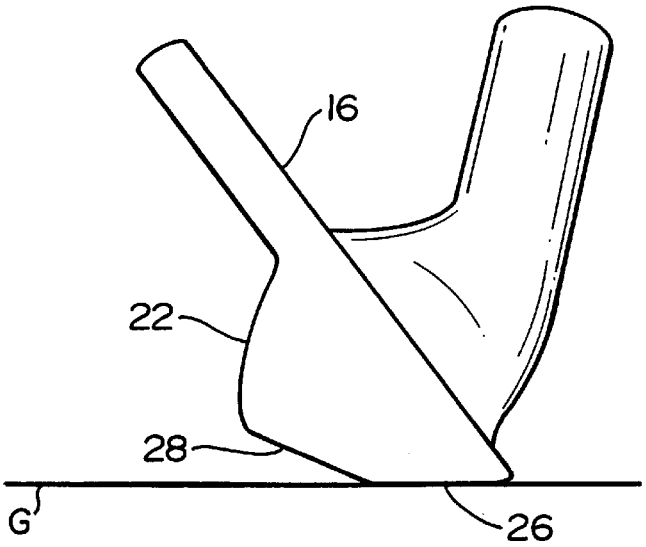
FIG. 3 is a side elevational view showing the golf club head supported on a first support level.
Figure 4:
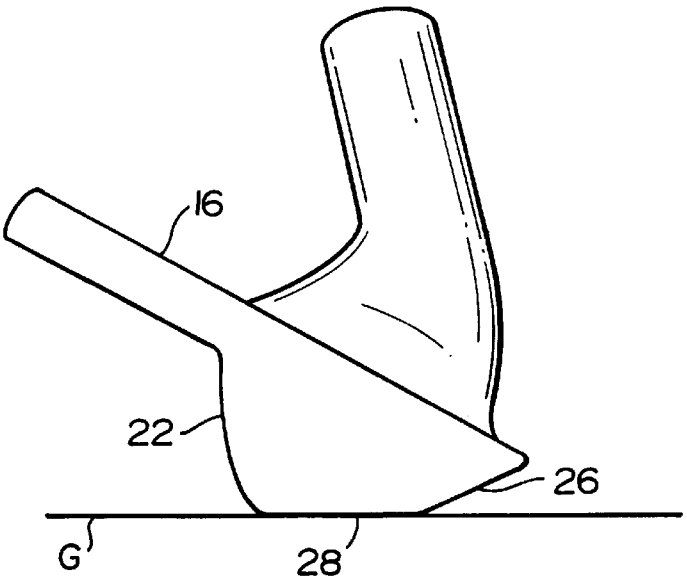
FIG. 4 is a side elevational view showing the golf club head being supported on a second support level.
Figure 5:
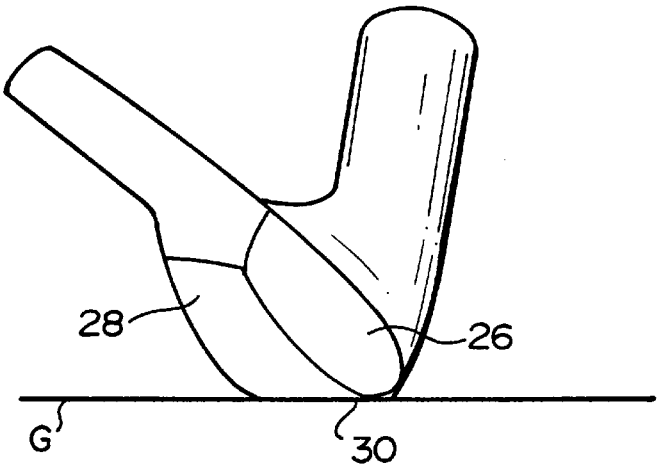
FIG. 5 is a side elevational view showing the golf club head being supported on a third support level.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, a wedge type iron golf club head 10 is shown having a conventional hosel 12 and club head body 14 including a ball striking face 16, heel section 18, toe section 20, rear surface 22 and a multi-level bottom sole 24. The bottom sole 24 includes a first angular support surface 26, generally rectangular in shape, a second angular support surface 28, also generally rectangular in shape and a third triangular shaped angular support surface 30.

The first angular support surface 26 extends from a leading edge 32 formed at the interface of the bottom sole 24 and the ball striking face 16, to approximately a midline 34 on the sole 24 in a front to rear direction. The second angular support surface 28 extends from the midline 34 to a trailing edge 36, located at an interface of the bottom sole 16 and the rear surface 22. The third angular support surface 30 is formed offset from the first surface 26 and second surface 28, adjacent the heel section 18. The third surface 30 extends from the trailing edge 36 approximately one third of the distance toward the toe and angularly back toward the midline at the heel section 18.

Each support surface of the multi-level bottom sole 24 is formed at a different angle so that the golf club head 10 may be placed on a support surface so that the golf club assumes a different loft angle for each level. For example, the first support surface level 26 is formed at an angle relative to the ball striking face 16 corresponding to a pitching wedge. The second support surface level 28 is formed at an angle relative to the ball striking face 16 corresponding to a sand wedge, and the third support surface level 30 is formed at an angle with respect to the ball striking face 16 corresponding to a lob wedge.

With the golf club head 10 being connected to a suitable shaft and grip (not shown), it is used for playing a variety of golf shots. Initially, a golfer will decide what type of shot and what distance he needs to hit that shot before selecting the particular level at which the golf club is to be used. It will be appreciated that placing the club head 10 at the first level permits the ball to be hit further than placing the club head 10 at the succeeding second level or third level. If a golfer elects to hit a golf ball at a higher trajectory, he will use the second level or third level. When a particular level is selected, the support surface corresponding to that level is placed on the ground. When one support surface is in contact with the ground, the other support surfaces are raised above the support surface and thus will not affect the overall loft angle which the club head assumes.

It will be appreciated that each support surface level results in a different bounce angle when the club is placed on the ground. The first support surface has a positive bounce angle, whereas the second support surface has a negative bounce angle.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. An iron type golf club including a heel, toe, ball striking face, a rear surface and a bottom sole extending between said heel and said toe; said bottom sole comprising:

a leading edge at the interface of said ball striking face and said bottom sole; a trailing edge at the interface of said rear surface and said bottom sole; a midline extending in a heel to toe direction on said bottom sole; said bottom sole having a first support surface, a second support surface and a third support surface; said first support surface located between said leading edge and said midline at a first angle with respect to said ball striking face; said second support surface located between said midline and said trailing edge at a second angle with respect to said ball striking face; said second angle being greater than said first angle; and a third support surface located adjacent said heel at a third angle with respect to said ball striking face; said third angle being greater than said second angle.

2. The golf club head of claim 1 wherein said first and said second support surfaces are generally rectangular in shape and extend between said heel and said toe; and said third surface is generally triangular in shape.

3. The golf club head of claim 2 wherein said triangular third surface includes legs and a base; one leg extending along said trailing edge to an apex approximately one third the distance toward said toe; a second leg extending from said apex to a point where the midline intersects the heel; and, a base between said legs extending across said heel.

4. An iron type golf club head including a shaft connection and a club head body; said body having a heel section, a toe section, a ball striking face, a leading edge, a trailing edge and a rear surface wherein the improvement comprises:

a bottom sole having a first level support surface at a first angle relative to said ball striking face, a second level support surface at a second angle, greater than said first angle, relative to said ball striking face, and a third level support surface offset laterally from said first and said second levels at a third angle, greater than said second angle, relative to said ball striking face; said first level located between said leading edge and a midline on said bottom sole; said second level located between said trailing edge and said midline on said bottom sole; and said third level located at said heel section.

* * * * *